US005337066A

United States Patent [19]

Hirata et al.

[11] Patent Number: 5,337,066

[45] Date of Patent: Aug. 9, 1994

[54] ANTENNA SYSTEM WITH A LIMITABLE COMMUNICATION AREA

[75] Inventors: Tatsuya Hirata, Ichinomiya; Atsushi Watanabe, Toyokawa; Naoki Tokitsu, Kariya, all of Japan

[73] Assignee: Nippondenso Co., Ltd., Kariya, Japan

[21] Appl. No.: 943,429

[22] Filed: Sep. 14, 1992

[30] Foreign Application Priority Data

Sep. 13, 1991 [JP] Japan ..... 3-234617

[51] Int. Cl.[5] ..... H01Q 1/52; H01Q 17/00

[52] U.S. Cl. ..... 343/841; 343/793; 343/700 MS

[58] Field of Search ..... 343/841, 793, 810, 700 MS, 343/813, 720, 721; 342/1, 2, 3, 4; H01Q 1/52, 17/00

[56] References Cited

U.S. PATENT DOCUMENTS 3,377,593 4/1968 Sansom ..... 343/766
3,501,766 3/1970 Crumpen ..... 343/771

FOREIGN PATENT DOCUMENTS 0323826 7/1989 European Pat. Off. ..... H01Q 17/00
2390027 12/1978 France .
2512280 3/1983 France .
61-2432 1/1986 Japan .
3167893 7/1991 Japan ..... H01Q 17/00
9109323 6/1991 PCT Int'l Appl. .

OTHER PUBLICATIONS

Dybdal, "Horn Antenna Sidelobe Reduction Using Absorber Tunnels", Institute of Electrical and Electronics Enginers AP-S Int. Symposium 1977, Stanford, Calif., pp. 324–327.

*Primary Examiner*—Donald Hajec
*Assistant Examiner*—Hoanganh Le
*Attorney, Agent, or Firm*—Cushman, Darby & Cushman

[57] ABSTRACT

An antenna system, comprising an antenna for transmitting a radio wave of a frequency, and a radio wave absorber intercepting and absorbing part of the radio wave to reduce the gain of the antenna. Thereby, the antenna system narrows down the communication area of the radio wave independently of the frequency. The antenna system is applicable to a movable object discriminator using a radio wave.

11 Claims, 9 Drawing Sheets

TO CLASSIFIER

ANTENNA SYSTEM WITH A LIMITABLE COMMUNICATION AREA

BACKGROUND OF THE INVENTION

1. Field of the Invention

The present invention relates to an antenna system applicable to a radio communication system, in particular to a system, using high-frequency radio waves. Especially, the inventive antenna system is applied to a movable object discriminator having an interrogator transmitting and receiving radio waves to and from a responder.

2. Description of the Related Art

Generally, when a person desires to communicate with a particular movable object using radio communication, he must employ a directional antenna. Antennas that are directable include a Yagi-Uda antenna, an array antenna, a horn antenna, a parabolic antenna and the like. When the frequency of a radio wave is in belongs to a milliwave or EHF (Extremely High Frequency) band of 30 GHz or more (e.g. 30–300 GHz), these antennas can have a high directivity, although they are small.

However, when they are conventionally applied to a radio communication using a radio wave of a frequency of less than 30 GHz, e.g., microwave or UHF (i.e. 300 MHz to 3 GHz) band, they must be large. This causes the following problems for movable object discriminators transmitting an interrogatory radio wave of a frequency of 2.45 GHz and receiving a responding radio wave of the frequency of 2.45 GHz.

A movable object discriminator of a very short communication distance (approximately 2 m at maximum) in a low-power communication earnestly desires to transmit to and receive from only a responder having come to a predetermined position, so that a communication area must be narrowed down. In order to narrow down a communication area, a directional antenna such as an array antenna is generally employed. However, the array antenna, for example, must comprise a great number of antenna elements arrayed in matrix form in order to sharply narrow down the communication area toward a particular direction in employing a radio wave of the frequency (i.e. 2.45 GHz). This causes inappropriately increases the size of the array antenna, so that a communication area below the size of the antenna is not available. In other words, such an antenna has a problem in that the size of the antenna determines limits in narrowing down the communication area by frequency of radio wave.

SUMMARY OF THE INVENTION

Therefore, an object of the present invention is to provide an antenna system which can narrow down a communication area independently of frequency of radio wave.

Another object of tile present invention is to provide an antenna system which can narrow down its communication area independently of frequency of radio wave and is applicable to a movable object discriminator.

An antenna system according to a first embodiment of the present invention comprises an antenna for transmitting a radio wave of a frequency and means for intercepting and absorbing part of the radio wave to reduce the gain of the antenna, thereby narrowing down the communication area of the radio wave independently of the frequency. Thus, the antenna need not narrow down the communication area by its configuration, although the antenna transmits the radio wave toward more directions.

The antenna system according to the first embodiment of the present invention may further comprise means for narrowing down the communication area to be directed toward a particular direction.

The antenna system according to the first embodiment of the present invention may further comprise a light transmitter transmitting a beam of light toward the particular direction.

An antenna system according to a second embodiment of the present invention comprises an antenna in the form of a board transmitting a radio wave of a frequency from the front surface thereof, and two radio wave absorbers in the form of board, the largest surfaces of the radio wave absorbers being positioned opposite each other through the normal line to the center of the front surface of the antenna, the front edges of the radio wave absorbers defining a radio wave transmitting area of the antenna system.

The antenna according to the second embodiment of the present invention may further comprise hinges joining rear edges of the radio wave absorbers to the antenna, the hinges enabling the radio wave transmitting area to be variable. Thus, this antenna system enables a person to optionally select a communication area simply by means of changing a setting angle of each of the radio wave absorbers to the antenna.

In the antenna system according to the second embodiment of the present invention, each of the radio wave absorbers may be movable transversely to the antenna to change the radio wave transmitting area.

In the antenna system according to the first embodiment of the present invention, each of the radio wave absorbers may be made of a composite of a ferrite plus an epoxide.

In the antenna system according to a second embodiment of the present invention, each of the radio wave absorbers may alternatively be made of a composite of a ferrite plus a rubber.

In the antenna system according to a second embodiment of the present invention, each of the radio wave absorbers may alternatively be made of a composite of conductive fibers plus urethane foam.

In the antenna system according to the second embodiment of the present invention, each of the radio wave absorbers may alternatively be made of a plastic material of a ferrite plus a plastic rubber and rear edges of the radio wave absorbers are fastened to the antenna.

The antenna system according to the second embodiment of the present invention may further comprise two second radio wave absorbers fixedly arranged opposite side edge surfaces of the antenna. The rear portions of the first radio wave absorbers may have a larger thickness than the front portions of the first radio wave absorbers.

In the antenna system according to the second embodiment of the present invention, the antenna may include a plurality of antenna elements in the form of board arrayed in line in a common plane.

In the antenna system according to the second embodiment of the present invention, the antenna may be in a dipole form.

An antenna system according to a third embodiment of the present invention comprises a conductive support, an antenna for transmitting a radio wave of a frequency, the antenna being fastened to a front portion of the support, two radio wave absorbers in the form of boards, the largest surfaces of the radio wave absorbers being positioned opposite each other through the normal line to the center of the front surface of the antenna, the front edges of the radio wave absorbers defining a radio wave transmitting area of the antenna system, hinges joining rear edges of the radio wave absorbers to the antenna, the hinges enabling the radio wave transmitting area to be variable, a radio interference guard made of conductive material arranged to opposite side edge surfaces of the support.

The antenna system according to the third embodiment of the present invention may further comprise a housing containing the antenna, the support board, the radio wave absorbers and the hinges.

In the antenna system according to the third embodiment of the present invention, the support may be electrically connected to the radio interference guard.

The antenna system according to the third embodiment of the present invention may further comprise a second antenna for transmitting a radio wave of a frequency, the second antenna being fastened to a rear portion of the support, two second radio wave absorbers in the form of board, largest surfaces of the second radio wave absorbers being opposite each other through the normal line to the center of the rear surface of the second antenna, the rear edges of the second radio wave absorbers defining a second radio wave transmitting area of the antenna system, second hinges joining front edges of the second radio wave absorbers to the second antenna, the second hinges enabling the second radio wave transmitting area to be variable.

DESCRIPTION OF THE PREFERRED EMBODIMENTS

Figure 1A:
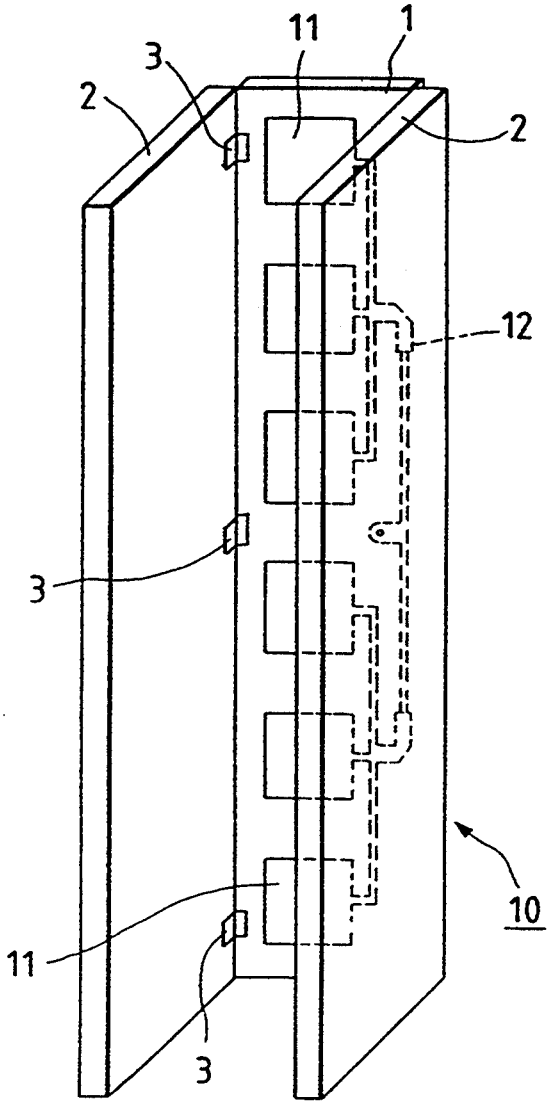
FIG. 1A is a perspective view of an array antenna system according to a first embodiment of the present invention.
Figure 1B:
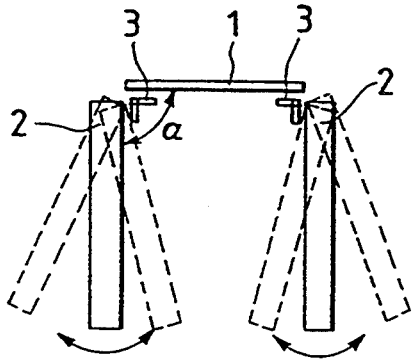
FIG. 1B is a plan view of the array antenna system of FIG. 1A.

Preferred embodiments of the present invention will be described with reference to the drawings hereinafter. As shown in FIGS. 1A and 1B, an array antenna 1 in the form of rectangular board of an array antenna system 10 comprises a plurality of antenna elements 11 in the form of square board arrayed vertically in line. Each antenna element 11 receives electric power from an electric power feeder 12 and transmits radio waves of UHF and SHF (Super High Frequency) bands (i.e. 3–30 GHz). Right-hand and left-hand side edges of the front surface of the array antenna 1 have radio wave absorbers 2 in the form of a rectangular board connected to the array antenna 1 by means of hinges 3 and extending forward from the array antenna 1. As shown in FIG. 1B, the hinges 3 enable each of the radio wave absorbers 2 to be pivoted right and left.

The radio wave absorbers 2 and the hinges 3 constitute a means for changing the radio wave transmission area S of the array antenna system 10. Each of the radio wave absorbers 2 absorbs a radio wave transmitted from the array antenna 1 toward an undesired direction. When the array antenna system 10 is applied to a movable object discriminator having a frequency of 2.45 GHz, the radio wave absorbers 2 are made of a composite of a ferrite plus an epoxide, or a ferrite plus a rubber, or conductive fibers plus urethane foam.

Figure 3A:
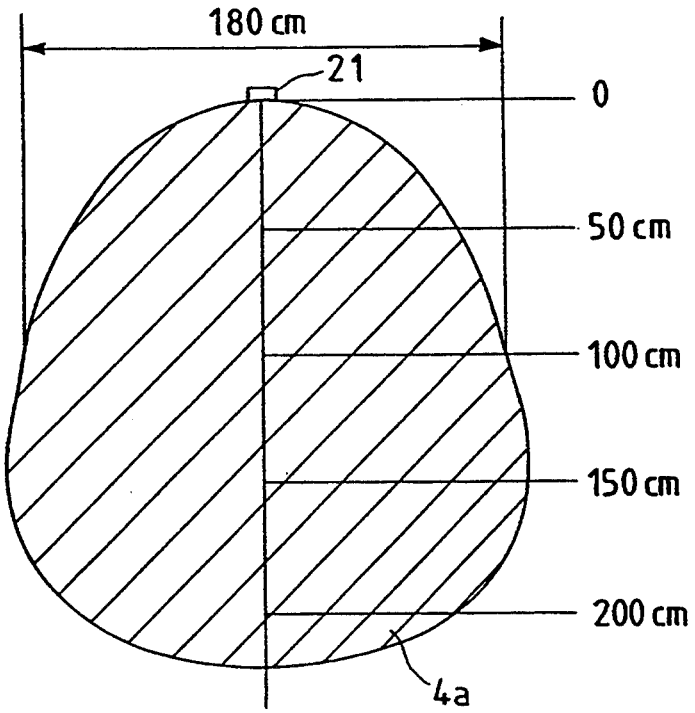
FIG. 3A PRIOR ART
FIG. 3A is a diagrammatic plan view of the communication area of the array antenna of FIG. 2A.

Operation of the array antenna system 10 will be described hereinafter. When all of the antenna elements 11 have received electric power from the electric power feeder 12, the array antenna 1 transmits a radio wave. If the array antenna 1 has no radio wave absorber, the front surface of the array antenna 1 transmits a radio wave in directions in a radiation pattern as shown in FIG. 3A. However, the radio wave absorbers 2 of the present embodiment intercept and absorb part of the radio wave transmitted from the array antenna 1 since the array antenna 1 actually has the radio wave absorbers 2. The arrangement of the array antenna 1 and the radio wave absorbers 2 causes the radio wave absorbers 2 to mainly intercept and absorb part of the transmitted radio wave propagating substantially transversely to the array antenna 1 and cut the transverse propagation of the radio wave, thus producing a communication area in the form of a lobe.

As shown in FIG. 1B, the degree of opening or setting angle a of each radio wave absorber 2 to the array antenna 1 is variable, the array antenna system 10 can optionally change which part of the radio wave transmitted by the array antenna 1 is absorbed by the radio wave absorbers 2, so that a desired radiation pattern for radio communication can be produced and the communication area can desirably be narrowed down.

The radiation pattern of the array antenna system 10 which is embodied into an array antenna system 10*a* of an interrogator of the movable object discriminator will be described hereinafter. The array antenna system 10*a* transmits a radio wave of the frequency of 2.45 GHz of UHF band allotted to the movable object discriminator.

Figure 2A:
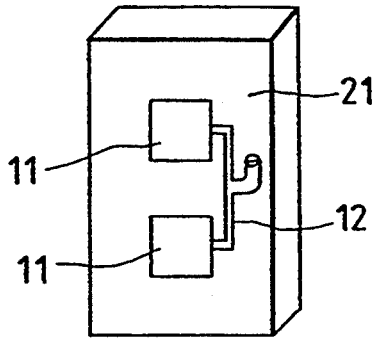
FIG. 2A PRIOR ART
FIG. 2A is a perspective view of a prior-art two-element array antenna.
Figure 2B:
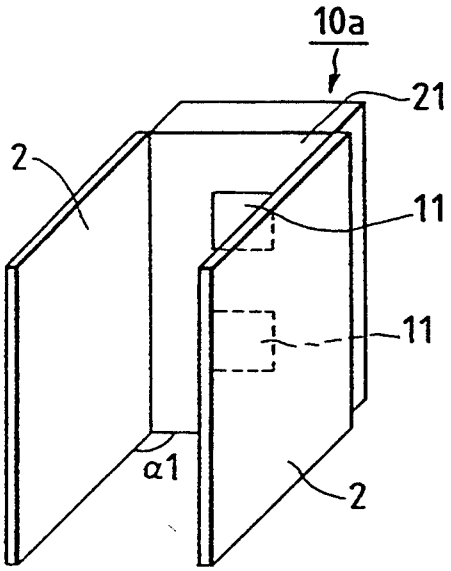
FIG. 2B is a perspective view of a first configuration of an array antenna system employing the array antenna of FIG. 2A.
Figure 2C:
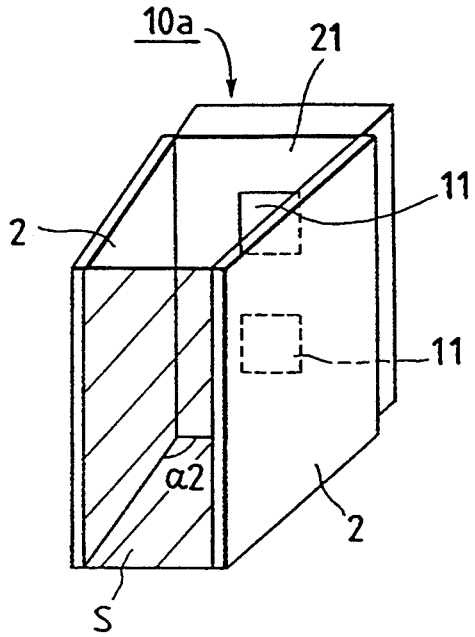
FIG. 2C is a perspective view of a second configuration of the array antenna system employing the array antenna of FIG. 2A.

FIG. 2A is a prior-art two-element array antenna 21 used for determination of communication area. The array antenna 21 in the form of rectangular board includes two antenna elements 11 arrayed vertically in line and has no radio wave absorber. FIGS. 2B and 2C show first and second configurations of the array antenna system 10*a* with two-element array antenna 21. The first configuration of the array antenna system 10*a* of FIG. 2B has a setting angle $\alpha_1$ (=90°) of the radio wave absorbers 2 to the array antenna 21. Therefore, an opening defined by the front edges of the pair of radio wave absorbers 2 is equal to the front surface of the array antenna 21.

The second configuration of the array antenna system 10*a* of the FIG. 2C has a setting angle $\alpha_2$ (i.e. an acute angle) of the radio wave absorbers 2 to the array antenna 21. Therefore, an opening defined by the front edges of the pair of radio wave absorbers 2 is narrower than the front surface of the array antenna 21.

Figure 3B:
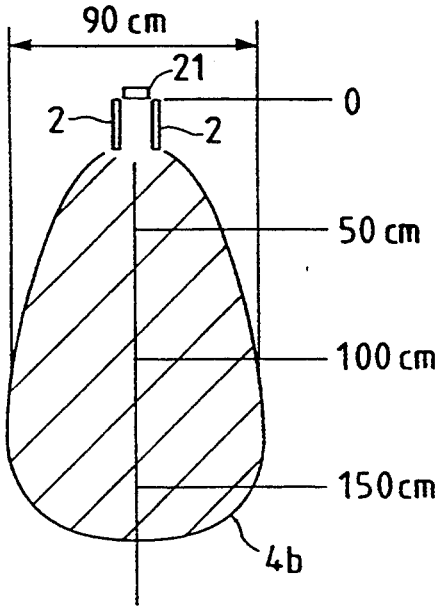
FIG. 3B is a diagrammatic plan view of the communication area of the array antenna system of FIG. 2B.
Figure 3C:
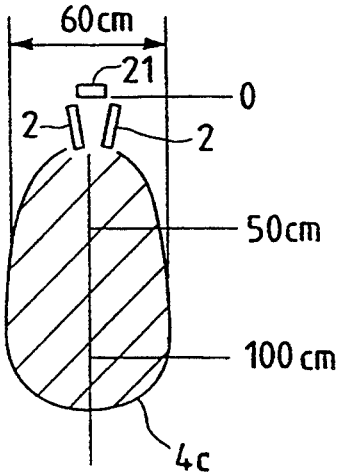
FIG. 3C is a diagrammatic plan view of the communication area of the array antenna system of FIG. 2C.

FIG. 3A is a diagrammatic plan view of a communication area or radiation pattern of the array antenna system of FIG. 2A. FIG. 3B is a diagrammatic plan view of a communication area or radiation pattern of the first configuration of the array antenna system 10*a* of FIG. 2B. FIG. 3C is a diagrammatic plan view of a communication area or radiation pattern of the second configuration of the antenna system 10*a* of FIG. 2C.

The prior-art array antenna system, as shown in FIG. 3A, has a hatched communication area 4*a*. The first configuration of the array antenna system 10*a* of FIG. 2B, as shown in FIG. 3B, has a hatched communication area 4*b*. The second configuration of the array antenna system 10*a* of FIG. 2C, as shown in FIG. 2C, has a hatched communication area 4C. Each of the radio wave absorbers 2 of FIGS. 2B and 2C is made of a material absorbing 99% and reflecting 1% of a radio wave transmitted thereto. As shown in FIG. 3A, the communication area 4*a* has a width of 180 cm at the distance of 1 m (i.e. substantially a half of the maximum distance of the communication area) forward from the front surface of the array antenna 21 of the prior-art antenna system. As shown in FIG. 3B, the communication area 4*b* has a width of 90 cm at the distance of 1 m forward from the front surface of the array antenna 21 of the first configuration of the antenna system 10*a*. As shown in FIG. 3C, the communication area 4*c* has a width of 60 cm at the distance of 1 m forward from the front surface of the array antenna 21 of the second configuration of antenna system 10*a*. Thus, the width of the communication area 4*b* of the first configuration of the array antenna system 10*a* is ½ of that of the prior-art array antenna system at the distance of 1 m forward from the array antenna 21. The width of the communication area 4*c* of the second configuration of the antenna system 10*b* is ⅓ of that of the prior-art array antenna system at the equal distance.

Figure 7:
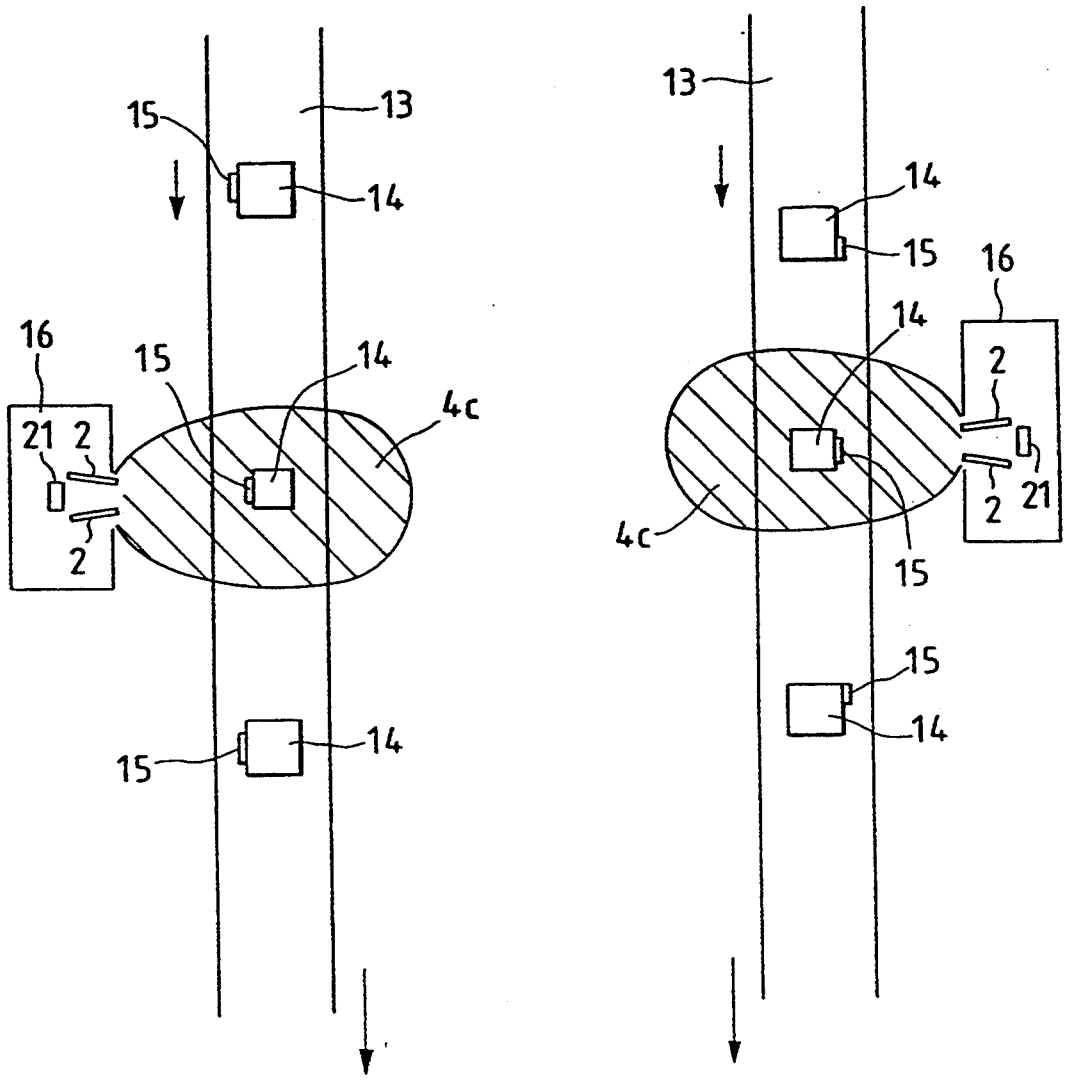
FIG. 7 is a schematic diagram of an article delivery system employing the array antenna system of FIG. 2C.

It is important to the movable object discriminator to narrow down the communication area of the radio wave. A case where an array antenna system having a narrowed communication area is applied to a movable object discriminator of an article delivery system will be described with reference to FIG. 7 hereinafter. In the article delivery system, all of articles 14 entrusted to be delivered have responders 15 attached thereto, articles 14 which have been collected are loaded on a plurality of belt conveyors 13, an interrogator 16 for each belt conveyor 13 has the second configuration of the array antenna system 10*a* of FIG. 2C and reads delivery data from each responder 15, and a classifier (not shown) classifies the articles 14 by destinations.

If the interrogators 16 have the prior-art array antenna systems of FIG. 2A instead of the array antenna systems 10*a*, the interrogators 16 experience radio interference with a plurality of responders 15 since many articles 14 are densely loaded on the belt conveyors 13. Thus, the interrogators 16 possibly establish a radio communication with a responder 15 not targeted (including a responder 15 attached to an article 14 loaded on an opposite belt conveyor 13), so that the article delivery system misfunctions. For example, the interrogators 16 misreads data from the responder 15 so that the classifier mistakes a destination of an article 14.

The array antenna system 10*a* of the present embodiment can appropriately narrow down the communication area although it employs a radio wave of UHF band. Thus, each of the interrogators 16 communicate with the responders 15 one at a time, so that the article delivery system of FIG. 7 can avoid the above-described malfunction.

In addition, since the radio wave absorbers 2 of the second configuration of the antenna system 10*a* produce the narrowed communication area 4*c*, the array antenna 21 need not narrow down the communication area only by means of a configuration thereof including arraying conventionally a great number of antenna elements. Thus, the present embodiment of the invention can reduce the size of the antenna system including the array antenna 21 and narrow down the width of the communication area and the maximum range or distance of the communication area independently of frequency of radio wave.

As shown in FIGS. 3B and 3C, a simple change in the setting angle of the radio wave absorbers 2 to the two-element array antenna 21 changes a radio wave transmitting area S to easily change the width and the maximum distance of the communication area. Thus, the antenna system of the present embodiment can change the communication area by uses and by environments of use and allows a fine adjustment in a scene of use of the antenna system. This overcomes the problem in the conventional array antenna system that the number of arrayed antenna elements determines a communication area so that the conventional antenna system must be changed by uses and by environments of use.

In addition, narrowing down the width of the communication area reduces the communication distance forward from the front surface of the two-element array antenna 21 of the array antenna system 10*a*. This indicates that narrowing down the width of the communication area reduces the gain of the antenna system 10*a*. Therefore, when the gain G of a configuration of the array antenna system 10*a* producing the largest communication area is selected to be no more than the legal largest gain (e.g. 20 dB for a movable object discriminator), a gain of the antenna system 10*a* when the radio wave absorbers 2 extremely narrows down the communication area is simply increased to the gain G. Thus, even if the directivity of the antenna system 10*a* is high, the antenna system 10*a* may legally be used.

Figure 4:
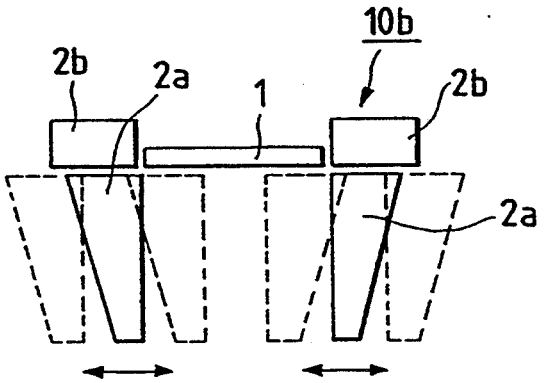
FIG. 4 is a plan view of an antenna system according to a second embodiment of the present invention.

FIG. 4 shows an antenna system according to a second embodiment of the present invention. This antenna system 10b has no hinge connecting an array antenna 1 in the form of rectangular board to a pair of radio wave absorbers 2 in the form of rectangular board. A pair of radio wave absorbers 2b is fixedly placed to the side edge surfaces of the array antenna 1 so that the front surfaces of the array antenna 1 and the radio wave absorbers 2b are in the same plane, and the radio wave absorbers 2a are disposed in front of an assembly of the array antenna 1 and the radio wave absorbers 2b and movable transversely to the array antenna 1. Moving the radio wave absorbers 2a toward right and left, changes the radio wave transmitting area of the antenna system 10b to change the communication area of the antenna system 10b.

As shown in FIG. 4, the cross section of each of the radio wave absorbers 2a has a form in which the thickness of the radio wave absorber 2 decreases from its rear edge to its front edge so that the radio wave absorbers 2a effectively absorb astray radio waves substantially transversely transmitted from the array antenna 1 together with the fixed radio wave absorbers 2b. Thus, the antenna system 10b transmits a radio wave of a high directivity to produce the communication area sharply narrowed down forward from the array antenna 1.

Figure 5:
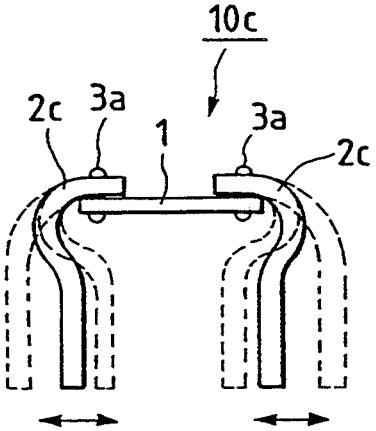
FIG. 5 is a plan view of an antenna system according to a third embodiment of the present invention.

FIG. 5 shows an array antenna system 10c according to a third embodiment of the present invention. This array antenna system 10c has no hinge connecting a pair of radio wave absorbers 2c to an array antenna 1 in the form of rectangular board. Rear edges of the radio wave absorbers 2c made of a plastic material of a ferrite plus a plastic rubber are joined to the right-hand and left-hand edges of the array antenna 1 by means of fasteners 3a (e.g. rivets) so that the rear edges of the radio wave absorbers 2c are attached to the rear surface of the array antenna 1 and rear parts of the radio wave absorbers 2c are bent around the right-hand and left-hand edges of the array antenna 1. Transverse positions of free front edges of the radio wave absorbers 2c extending forward from the array antenna 1 are changed and fixed there by the plasticity of the radio wave absorbers 2c to change the radio wave transmitting area and the communication area of the array antenna system 10c.

If the radio wave absorbers 2c are made of a material of a ferrite plus a rubber lacking plasticity, a suitable fastener means (not shown) is used to releasably fix a radio wave transmitting area defined by the free front edges of the radio wave absorbers 2c.

Figure 6A:
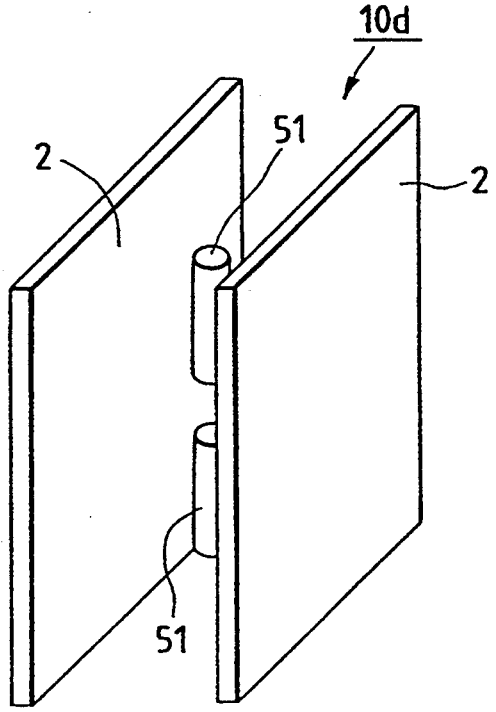
FIG. 6A is a perspective view of a dipole antenna system according to a fourth embodiment of the present invention.
Figure 6B:
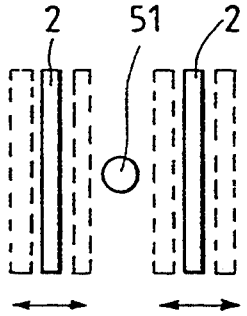
FIG. 6B is a plan view of the dipole antenna system of FIG. 6A.
Figure 8:
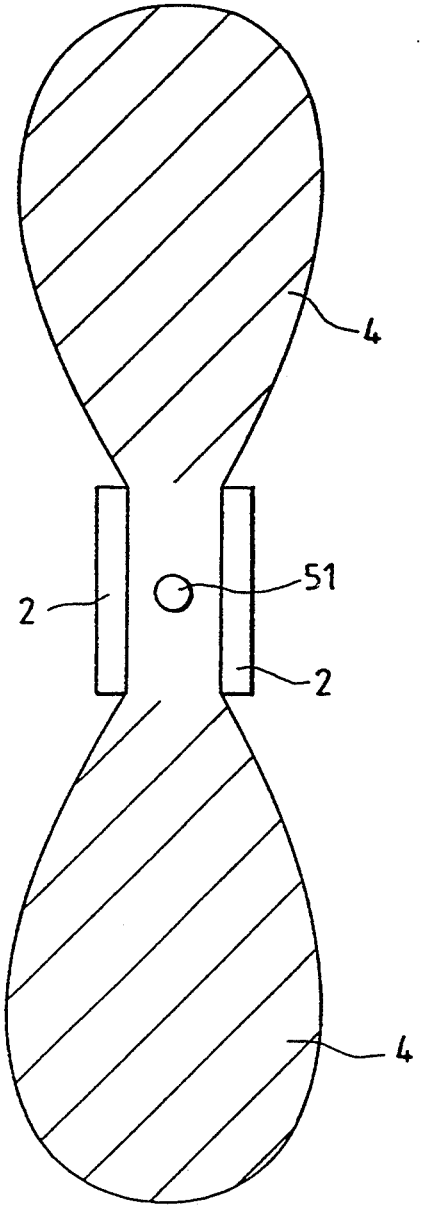
FIG. 8 is a diagrammatic plan view of the communication area of the dipole antenna system of FIG. 6A.

FIGS. 6A and 6B show a dipole antenna system 10d according to a fourth embodiment of the present invention. The dipole antenna system 10d employs a vertical dipole antenna 51 and a pair of radio wave absorbers 2 in the form of rectangular board. The radio wave absorbers 2 vertically extend and are arranged symmetrically with respect to the dipole antenna 51. As shown in FIG. 6B, the radio wave absorbers 2 are horizontally movable. As shown in FIG. 8, the dipole antenna system 10d produces a pair of symmetrical communication areas 4 in the form of a lobe in front and rear of the dipole 51. The radio wave absorbers 2 cut part of a communication area of the dipole 51 to transversely extend so that the dipole antenna system 10d produces the pair of communication areas 4 narrowed down in the form of the lobe. The communication areas 4 depend on horizontal positions of the radio wave absorbers 2.

Figure 9A:
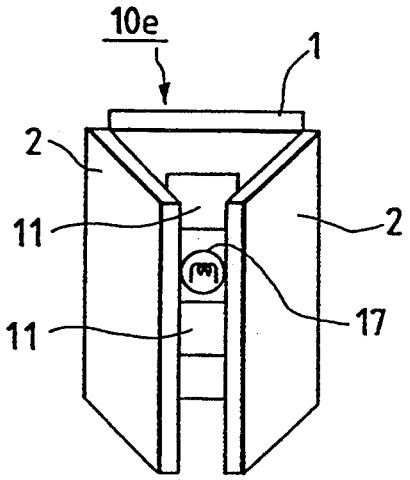
FIG. 9A is a perspective view of an array antenna system according to a fifth embodiment of the present invention.
Figure 9B:
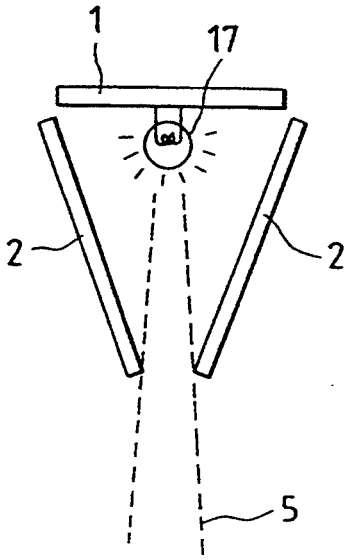
FIG. 9B is a plan view of the array antenna system of FIG. 9A.

FIGS. 9A and 9B show an array antenna system 10e according to a fifth embodiment of the present invention. The front surface of the array antenna 1 in the form of rectangular board has a light transmitter (e.g. an electric lamp or LED) 17 fixed to the centerline thereof near the antenna elements 11. The light transmitter 17 is lit if necessary. Thus, a beam of light 5 from the light transmitter 17 passing through the radio wave transmitting area defined by the front edges of the radio wave absorbers 2 in the form of rectangular board, as shown in FIG. 9B, roughly indicates the communication area of the antenna system 10e so as to facilitate an adjustment of the communication area (i.e. the width of the communication area and thus the maximum distance of the communication area) of the array antenna system 10e.

Figure 10A:
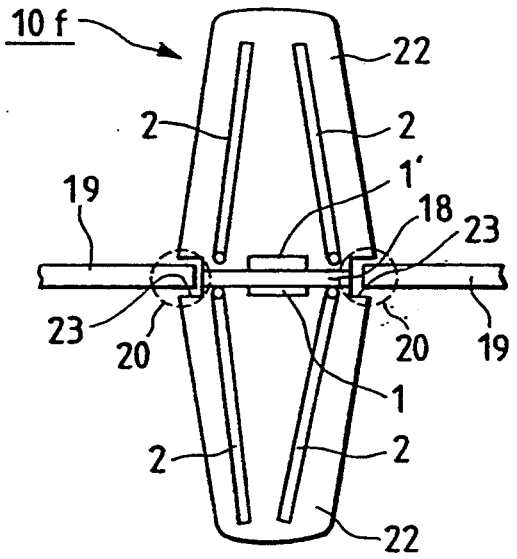
FIG. 10A is a plan view of an array antenna system according to a sixth embodiment of the present invention.
Figure 10B:
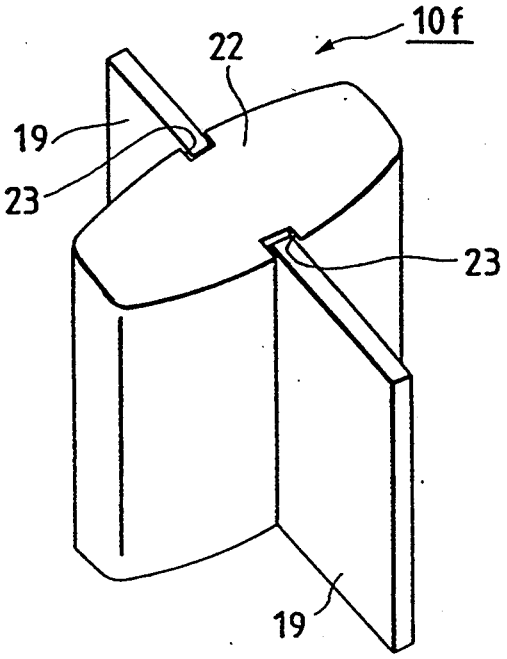
FIG. 10B is a perspective view of the array antenna system of FIG. 10A.

FIGS. 10A and 10B show an array antenna system 10f according to a sixth embodiment of the present invention. As shown in FIG. 10A, two array antennas 1 and 1' in the form of rectangular board are mounted on the front and rear surfaces of a conductive support board 18 opposite each other. Right-hand and left-hand edges of the front and rear surfaces of the support board 18 have two pairs of radio wave absorbers 2 in the form of rectangular board pivotally mounted thereto. A setting angle of the radio wave absorbers 2 of each pair to the front or rear surface of the support board 18 is acute, so that the front radio wave absorbers 2 are arranged tapering forward from the support board 18 and the rear radio wave absorbers 2 are arranged tapering rearward from the support board 18. A housing 22 contains all of the array antennas 1 and 1', the support board 18, and the radio wave absorbers 2. The central portions of the outer surfaces of the opposite sidewalls of the housing 22 define vertical grooves 23. Radio interference guards 19 in the form of rectangular board are fitted in the grooves 23 by suitable fixing means 20. The radio interference guards 19 are made of a conductive solid board or a conductive network and guard radio waves transmitted by the front and rear array antennas 1 and 1' from a radio interference. Thus, the front half of the array antenna system 10f including the front array antenna 1 and the rear half of the array antenna system 10f including the rear array antenna 1' operate independently of each other without radio interference. The array antenna system 10f can determine whether there is a responder 15 on a front or rear side of the support board 18.

Figure 11:
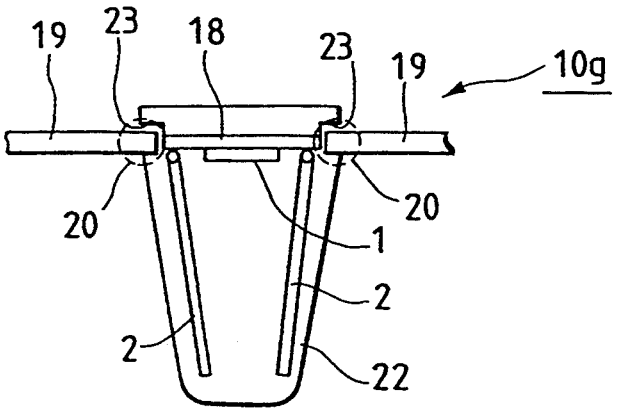
FIG. 11 is a plan view of an array antenna system according to a seventh embodiment of the present invention.

FIG. 11 shows an array antenna system 10g according to a seventh embodiment of the present invention. The array antenna system 10g comprises only the same front half of the array antenna system 10f of the sixth embodiment including the radio interference guards 19. The radio interference guards 19 guard a radio wave transmitted by the array antenna 1 from interfering with a radio wave transmitted by an antenna system near the array antenna system 10f. Therefore, if there is no antenna system near the array antenna system 10f, the radio interference guards 19 may be eliminated. If the radio interference guards 19 are in electrical contact with the support board 18 on large contact surfaces between each of the radio interference guards and the support board 18, the operation of the radio interference guards 19 is enhanced.

The above embodiments employ the array antenna 1 and the dipole antenna 51. The present invention may alternatively employ a horn antenna, a parabolic antenna, a Yagi-Uda antenna and an antenna including a single antenna element in the form of board. The radio wave absorbers 2 may alternatively be mounted to the top and bottom ends of the array antenna 1 and the dipole antenna 51 instead of the right-hand and left-hand sides of the array antenna 1 and the dipole antenna 51. The radio wave absorbers 2 may alternatively be mounted to all of the top and bottom ends and the right-hand and left-hand sides of the array antenna 1 and the dipole antenna 51.

The embodiment in which the present invention is applied to the movable object discriminator of the article delivery system has been described above. The present invention is also applicable to a parking-place control system opening and closing a gate or door in response to a radio wave from a responder, to a room entrance and exit control system and to a ticket examination system.

The present invention is also applicable to an automotive radar for sensing a vehicle-to-vehicle distance or the position of an obstacle. The automotive radar transmits a radio wave to a preceding automotive vehicle, receives a reflected radio wave from the preceding automotive vehicle and then determines a vehicle-to-vehicle distance between the preceding automotive vehicle and an automotive vehicle having this automotive radar. Thus, it is often desirable that the communication area of the radio wave has a relatively short range rather than a long range. In this case, an automotive radar antenna system of the present invention serves to detect only vehicles in a short range without increasing noises of detecting vehicles in a long range and without increasing the size of the radio transmitting antenna system since it narrows down the radio communication area with decreasing the gain of the antenna system.

The present invention is not rigidly restricted to the embodiments described above. It is to be understood that a person skilled in the art can easily change and modify the present invention without departing from the spirit of the invention defined in the appended claims.

What is claimed is:

1.An antenna system used in a movable object discriminator, comprising:

an antenna for transmitting a radio wave of a predetermined band of frequencies in a direction to produce a communication area of said radio wave in said direction;

means, provided in said direction, for intercepting and absorbing part of said radio wave to reduce a gain of said antenna and thereby narrow down said communication area independently of said frequencies;

means for enabling said intercepting and absorbing means to be pivotable about a pivot at a fixed position to set an angle $\alpha$ between said intercepting and absorbing means and said antenna to determine said communication area; and a light transmitter disposed adjacent to said antenna, said light transmitter transmitting a beam of light so that a cross-sectional area of said beam of light exiting from said intercepting and absorbing means indicates a transmission area S of said radio wave.

2. An antenna system, comprising:

an antenna In the form of a board transmitting a radio wave of a frequency from a front surface thereof;

two radio wave absorbers in the form of a board, largest surfaces of said radio wave absorbers being opposite each other through a normal line to a center of said front surface of said antenna, front edges of said radio wave absorbers defining a radio wave transmitting area of said antenna system; and hinges joining rear edges of said radio wave absorbers to said antenna, said hinges enabling said radio wave transmitting area to be variable.

3. An antenna system comprising:

an antenna in the form of a board transmitting a radio wave of a frequency from a front surface thereof;

two radio wave absorbers in the form of a board, wherein said radio wave absorbers are positioned adjacent to said front surface of said antenna such that the largest surfaces of said radio wave absorbers are opposite each other and generally parallel to a line perpendicular to said front surface of said antenna, front edges of said radio wave absorbers defining a radio wave transmitting area of said antenna system; and wherein each of said radio wave absorbers are movable transversely to said antenna to change said radio wave transmitting area.

4. The antenna system according to claim 3, further comprising:

two second radio wave absorbers fixedly arranged opposite side edge surfaces of said antenna; and wherein the rear portions of said first radio wave absorbers have a larger thickness than the front portions of said first radio wave absorbers.

5. An antenna system comprising:

an antenna in the form of a board transmitting a radio wave of a frequency from a front surface thereof;

two radio wave absorber in the form of aboard, wherein said radio wave absorbers are positioned adjacent to said front surface of said antenna and such that the largest surfaces of said radio wave absorbers are opposite each other on either side of a normal line to a center of said front surface of said antenna, front edges of said radio wave absorbers defining a radio wave transmitting area of said antenna system; and wherein each of said radio wave absorbers is made of a plastic material and rear edges of said radio wave absorbers are fastened to said antenna and wherein a change in the shape of each of said radio wave absorbers also changes said communication area.

6. An antenna system, comprising:

a conductive support;

an antenna for transmitting a radio wave of a frequency, said antenna being fastened to a front portion of said support;

two radio wave absorbers in the form of a board, largest surfaces of said radio wave absorbers being opposite each other through the normal line to the center of the front surface of said antenna, the front edges of said radio wave absorbers defining a radio wave transmitting area of the antenna system;

hinges joining rear edges of said radio wave absorbers to said antenna, said hinges enabling the radio wave transmitting area to be variable; and a radio interference guard made of a conductive material arranged to opposite side edge surfaces of said support.

7. The antenna system according to claim 6, further comprising:

a housing containing said antenna, said support board, said radio wave absorbers and said hinges.

8. The antenna system according to claim 6, wherein said support is electrically connected to said radio interference guard.

9. The antenna system according to claim 6, further comprising:

a second antenna for transmitting a radio wave of a frequency, said second antenna being fastened to a rear portion of said support; p1 two second radio wave absorbers in the form of a board, largest surfaces of said second radio wave absorbers being opposite each other through the normal line to the center of the rear surface of said second antenna, the rear edges of said radio wave absorbers defining a second radio wave transmitting area of the antenna system; and second hinges joining front edges of said second radio wave absorbers to said second antenna, said second hinges enabling the second radio wave transmitting area to be variable.

10. An antenna system used in a movable object discriminator, comprising:

an antenna for transmitting a radio wave of a predetermined band of frequencies in a direction to produce a communication area of said radio wave in said direction;

means, provided in said direction, for intercepting and absorbing part of said radio wave to reduce a gain of said antenna and thereby narrow down said communication area independently of said frequencies; and means for enabling said intercepting and absorbing means to be pivotable about a pivot at a fixed position to set an angle $\alpha$ between said intercepting and absorbing means and said antenna to determine said communication area.

11. An antenna system, comprising:

an antenna for transmitting a radio wave of a frequency in a direction to produce a communication area of said radio wave in said direction;

means, provided in said direction, for intercepting and absorbing part of said radio wave to reduce a gain of said antenna and thereby narrow down said communication area toward a desired direction independently of said frequency; and a light transmitter disposed adjacent to said antenna, said light transmitter transmitting a beam of light toward said desired direction so that a cross-sectional area of the beam of light emitted from said intercepting and absorbing means indicates a transmission area S of said radio wave.

* * * * *